US011804328B2

(12) United States Patent
Xie et al.

(10) Patent No.: US 11,804,328 B2
(45) **Date of Patent: *Oct. 31, 2023**

(54) INDUCTOR COIL AND ELECTROMAGNETIC COMPONENT

(71) Applicant: Eaton Intelligent Power Limited, Dublin (IE)

(72) Inventors: Fang Xie, Shenzhen (CN); Leo Sun, Shenzhen (CN); Kevin Lee, Menomonee Falls, WI (US); David Xu, Shenzhen (CN)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 17/886,938

(22) Filed: Aug. 12, 2022

(65) Prior Publication Data

US 2022/0384087 A1 Dec. 1, 2022

Related U.S. Application Data

(63) Continuation of application No. 15/118,943, filed as application No. PCT/CN2015/072842 on Feb. 12, 2015, now Pat. No. 11,437,179.

(30) Foreign Application Priority Data

Feb. 17, 2014 (CN) ..... 201410053640.9

(51) Int. Cl.
*H01F 27/28* (2006.01)
*H01F 27/30* (2006.01)
(Continued)

(52) U.S. Cl.
CPC ..... *H01F 27/2828* (2013.01); *H01F 27/306* (2013.01); *H01F 27/324* (2013.01);
(Continued)

(58) Field of Classification Search
CPC .. H01F 27/2828; H01F 27/306; H01F 27/324; H01F 3/14; H01F 27/33; H01F 2017/046
See application file for complete search history.

(56) References Cited

U.S. PATENT DOCUMENTS 2,494,180 A * 1/1950 Koubek ..... H01F 27/245
336/219
3,297,970 A * 1/1967 Jones ..... H01F 41/127
174/DIG. 8
(Continued)

FOREIGN PATENT DOCUMENTS

CN 2204670 8/1995
CN 1794383 A 6/2006
(Continued)

OTHER PUBLICATIONS

Juan Ai, Chinese International Searching Authority, International Search Report and Written Opinion, counterpart PCT Application No. PCT/CN2015/072842, dated Apr. 28, 2015, 18 pages total (including English translation of 10 pages).
(Continued)

*Primary Examiner* — Marlon T Fletcher
*Assistant Examiner* — Malcolm Barnes
(74) *Attorney, Agent, or Firm* — DiBerardino McGovern IP Group LLC

(57) ABSTRACT

The present invention provides an inductance coil comprising a magnetic core and a coil, wherein the coil is formed by winding a flat wire, and the flat surface of the wire is perpendicular to the axis around which the coil is wound. The coil is wrapped with an insulating adhesive tape and the tape is wound on the wire around an axis which is substantially in line with the direction along which the wire forming the coil extends, so as to form an isolation layer on the surface of the coil. Additionally, the present invention pro-
(Continued)

vides an electromagnetic device including the above inductance coil.

18 Claims, 3 Drawing Sheets

(51) Int. Cl.
*H01F 27/32* (2006.01)
*H01F 3/14* (2006.01)
*H01F 27/33* (2006.01)
*H01F 17/04* (2006.01)

(52) U.S. Cl.
CPC ..... *H01F 3/14* (2013.01); *H01F 27/33* (2013.01); *H01F 2017/046* (2013.01)

(56) References Cited

U.S. PATENT DOCUMENTS

| | | | | | |
|---|---|---|---|---|---|
| 3,600,801 | A * | 8/1971 | Larsen | H01F 41/125 310/216.081 |
| 3,735,168 | A * | 5/1973 | Anderson | H02K 15/12 336/209 |
| 4,376,904 | A * | 3/1983 | Horrigan | H01F 41/122 428/473.5 |
| 4,400,226 | A * | 8/1983 | Horrigan | H01F 41/122 156/185 |
| 4,504,098 | A | 3/1985 | Battarel et al. | |
| 4,734,976 | A | 4/1988 | Matson | |
| 4,750,077 | A * | 6/1988 | Amagasa | H02K 19/36 361/91.1 |
| 6,137,202 | A * | 10/2000 | Holmes | H02K 3/522 29/598 |
| 7,646,131 | B2 * | 1/2010 | Georg | H02K 29/03 310/216.069 |
| 8,487,733 | B2 | 7/2013 | Chu et al. | |
| 8,830,022 | B2 | 9/2014 | Inaba et al. | |
| 2004/0046634 | A1 | 3/2004 | Gokhale et al. | |
| 2004/0145444 | A1 | 7/2004 | Lee | |
| 2010/0079228 | A1 | 4/2010 | Halpin et al. | |
| 2010/0289607 | A1 | 11/2010 | Liu et al. | |
| 2012/0200381 | A1 | 8/2012 | Kimura et al. | |
| 2013/0107580 | A1 * | 5/2013 | Inaba | G05F 3/08 363/16 |
| 2014/0266535 | A1 | 9/2014 | Willis | |

FOREIGN PATENT DOCUMENTS

| | | | | |
|---|---|---|---|---|
| CN | 201097443 | Y | | 8/2008 |
| CN | 201237972 | | | 5/2009 |
| CN | 201237972 | Y | * | 5/2009 |
| CN | 101937191 | A | | 1/2011 |
| CN | 102074333 | A | | 5/2011 |
| CN | 201966036 | | | 9/2011 |
| CN | 102629511 | A | | 8/2012 |
| CN | 102782783 | A | | 11/2012 |
| CN | 102903491 | A | | 1/2013 |
| CN | 103177853 | A | | 6/2013 |
| CN | 203311971 | U | | 11/2013 |
| CN | 103489593 | A | | 1/2014 |
| EP | 0070661 | A1 | | 1/1983 |
| EP | 1441373 | A1 | | 7/2004 |
| EP | 2169818 | A2 | | 3/2010 |
| EP | 2367278 | A2 | | 9/2011 |
| JP | H0458415 | A | | 2/1992 |
| JP | H05198422 | A | | 8/1993 |
| JP | 2010266266 | A | | 11/2010 |

OTHER PUBLICATIONS

Extended European Search Report, counterpart European Patent Application No. 15849610.0, dated Sep. 20, 2017, 10 pages total.
Office Action, counterpart European Patent Application No. 15849610.0, dated Mar. 21, 2019, 6 pages total.
Office Action, counterpart European Patent Application No. 15849610.0, dated Sep. 9, 2020, 6 pages total.
Office Action and Search Report, counterpart Chinese Patent Application No. 201410053640.9 dated Jul. 19, 2017, 7 pages total.
Office Action and Search Report, counterpart Chinese Patent Application No. 201410053640.9 dated Feb. 23, 2018, 7 pages total.
Office Action and Search Report, counterpart Chinese Patent Application No. 201410053640.9 dated Jul. 27, 2018, 7 pages total.
Office Action and Search Report, counterpart Chinese Application No. 202010227606.4, dated Oct. 25, 2022, 23 pages total (including English translation of 14 pages).
Office Action, counterpart Chinese Application No. 202010227606.4, dated Apr. 15, 2023, 28 pages total (including English translation of 18 pages).

* cited by examiner

INDUCTOR COIL AND ELECTROMAGNETIC COMPONENT

CROSS-REFERENCE TO RELATED APPLICATIONS

This application is a continuation of U.S. patent application Ser. No. 15/118,943, titled Inductor Coil and Electromagnetic Component, which is the National Phase of International Application No. PCT/CN2015/072842, filed Feb. 12, 2015, which claims priority to Chinese Patent Application No. 201410053640.9, filed Feb. 17, 2014, each of which is incorporated herein by reference in its entirety.

FIELD OF THE INVENTION

The present invention relates to an inductance coil, and particularly, to a reactor.

BACKGROUND OF THE INVENTION

Reactor, which is used as reactive power compensation devices, is indispensable in the electric power system. It can be used to limit grid voltage surge and current surge caused by operating over-voltage, smooth spike pulses included in supply voltage, or smooth voltage defects generated during the commutation of bridge rectifier circuit, so as to effectively protect frequency converter and improve the power factor. It can not only prevent interference from the power grid, but also reduce harmonic current generated by rectifier unit to reduce pollution on the grid.

Reactor typically comprises a coil, a coil holder supporting the coil, and a magnetic core surrounded by the coil. The coil is typically made by winding the coil holder with a flexible copper wire. The magnetic core is then enclosed by the coil holder wound by the coil so as to constitute the core part of the reactor.

As electrical equipments are often applied in outdoor environment, the waterproof and dustproof requirements of the reactor are relatively high. The waterproof and dustproof methods that are commonly used by the conventional reactors are wrapping the reactor with an insulating adhesive tape. However, the shape of the combination of the coil, the coil holder and the magnetic core is irregular, and thus, it is difficult to completely attach the insulating adhesive tape on the coil without leaving gaps. Once there exists any gap between the adhesive tape and the coil, the waterproof and dustproof performance will be greatly reduced and thus hard to meet the waterproof and dustproof requirements of the reactor.

In order to further enhance the waterproof and dustproof performance of the reactor, the reactor can be placed in a housing and sealed with resin. However, the housing has a bigger volume, which results in an inductor occupying too much space in the electrical equipments, impairs the ventilation of the electrical equipments, and decreases the heat dissipation performance. Additionally, the poor thermal conductivity of the sealing resin also impairs the heat dissipation of the coil.

SUMMARY OF THE INVENTION

Therefore, the object of the present invention is to overcome the deficiencies of the prior art and provide a reactor.

The present invention provides an inductance coil comprising a magnetic core and a coil, wherein the coil is formed by winding a flat wire, and the flat surface of the wire is perpendicular to the axis around which the coil is wound. The coil is wrapped with an insulating adhesive tape, and the insulating adhesive tape is wound on the wire around an axis which is substantially in line with the direction along which the wire forming the coil extends, so as to form an isolation layer on the surface of the coil.

According to the inductance coil provided in the present invention, the winding direction of the insulating adhesive tape is perpendicular to the winding direction of the coil.

According to the inductance coil provided in the present invention, a gap between the magnetic core and the coil is filled with an insulating material.

According to the inductance coil provided in the present invention, a surface of the inductance coil is coated with a waterproof paint.

According to the inductance coil provided in the present invention, a leading out terminal of the coil is sleeved with a heat-shrinkable tube.

According to the inductance coil provided in the present invention, a leading out terminal of the coil is coated with a sealing gum.

According to the inductance coil provided in the present invention, the magnetic core is an E-I shaped magnetic core, and the coil is located to surround a central column of the E-I shaped magnetic core.

According to the inductance coil provided in the present invention, the magnetic core has an air gap, within which an insulating gasket is provided.

According to the inductance coil provided in the present invention, the inductance coil is a reactor, an inductor, a choke coil or a transformer coil.

The present invention further provides an electromagnetic device comprising the above mentioned inductance coil.

The inductance coil of the present invention does not have a coil holder and thus forms a coil without a coil holder. Therefore, the insulating adhesive tape can be tightly attached to the coil without leaving gaps, and there is no need to add additional waterproof and dustproof parts, for example housing and sealing resin, which will increase the volume of the inductance coil. The waterproof and dustproof performance of the inductance coil of the present invention is improved and its volume is reduced. In addition, the heat dissipation from the coil is not affected.

BRIEF DESCRIPTION OF THE DRAWINGS

Below, embodiments of the present invention are further described with reference to the attached drawings, wherein.

DETAILED DESCRIPTION OF THE INVENTION

In order to make the objects, technical solutions and advantages of the present invention clearer, the present invention is further illustrated in detail by the specific embodiments below. It should be understood that the specific embodiments described herein are merely used to explain the present invention and are not intended to limit the present invention.

Embodiment 1

The present embodiment provides a reactor comprising a magnetic core and a coil.

Figure 1:
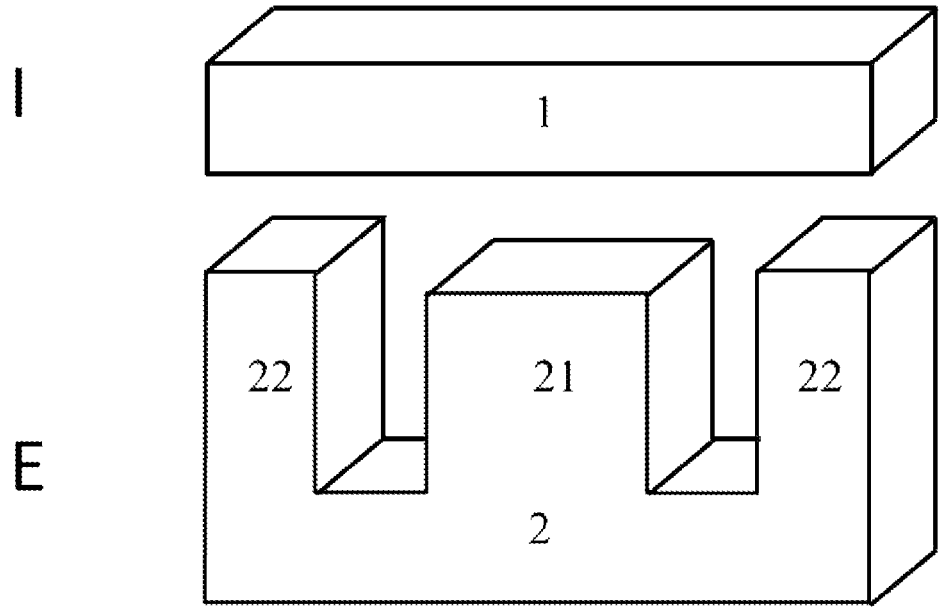
FIG. 1 is a schematic view of the E-I shaped magnetic core before installing the coil.
Figure 2:
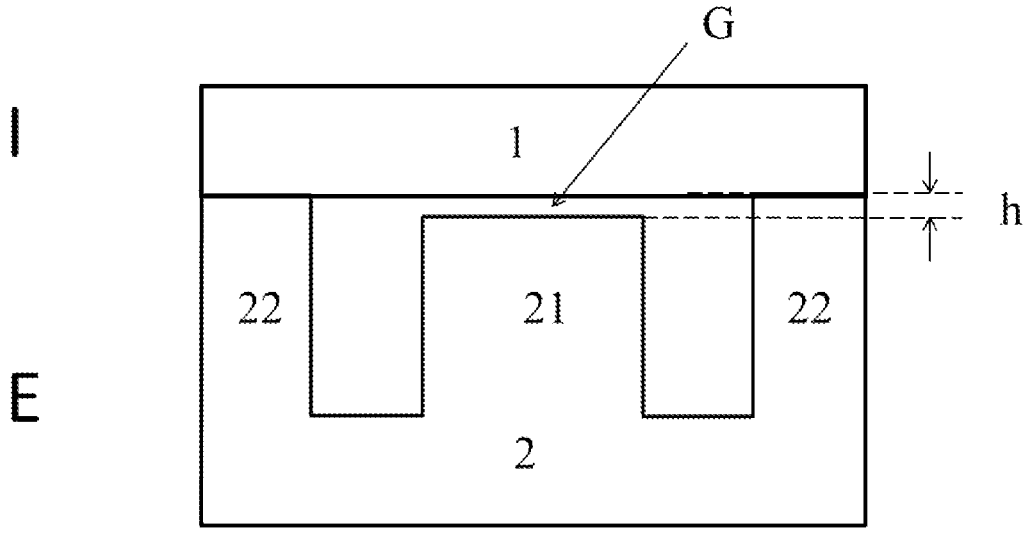
FIG. 2 is a front view of the combination of the E shaped magnetic core and I shaped magnetic core.

In this embodiment, the magnetic core of the reactor is an E-I shaped magnetic core. FIG. 1 shows a schematic view of the E-I shaped magnetic core before installing the coil. The E-I shaped magnetic core comprises an E shaped magnetic core 2 and an I shaped (i.e. elongate) magnetic core 1. The E shaped magnetic core 2 has a central column 21 and two side columns 22, wherein the height of the central column 21 is slightly lower than that of the two side columns 22. FIG. 2 shows a front view of the combination of the E shaped magnetic core 2 and I shaped magnetic core 1. The I shaped magnetic core 1 closely attaches to the two side columns 22 of the E shaped magnetic core 2 after assembling the magnetic core. Owing to the height difference h between the central column 21 and the two side columns 22, an air gap G with a height h is formed between the central column 21 and the I shaped magnetic core 1. The air gap can help the inductor store energy. If there were no air gap, the magnetic conductivity of the inductor would be large, and when a certain amount of current flows through the inductor, the inductor would be saturated and thus not be able to inhibit rapid increase of the current, i.e. the inductor would be out of action.

Figure 3:
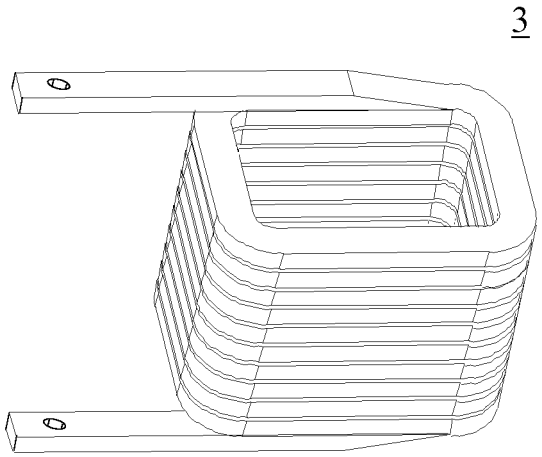
FIG. 3 is a schematic view of a vertical wrapping coil.
Figure 4:
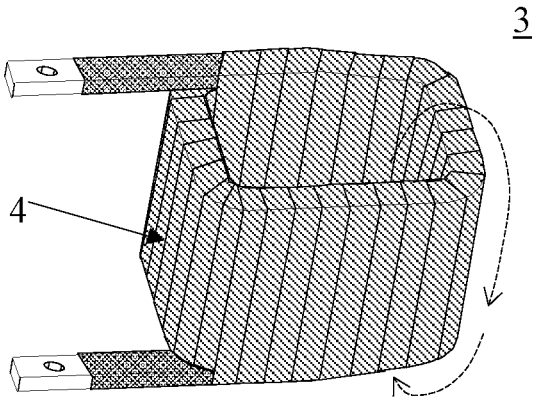
FIG. 4 shows a schematic view of a coil wrapped with an insulating adhesive tape.

The coil of the reactor provided in the present embodiment is a vertical wrapping coil, the structure of which is shown in FIG. 3. The coil 3 is formed by winding a flat wire, and the flat surface of the wire is perpendicular to the axis around which the coil is wound. In order to ensure its waterproof and dustproof performance, the coil is wrapped with an insulating adhesive tape. FIG. 4 shows a schematic view of a coil wrapped with the insulating adhesive tape 4, wherein the dotted arrow shows the winding direction of the insulating adhesive tape 4. As shown in FIG. 4, the winding direction of the insulating adhesive tape 4 is substantially perpendicular to the winding direction of the coil 3. In other words, the insulating adhesive tape 4 is wound on the wire around an axis which is substantially in line with the direction along which the wire forming the coil 3 extends. In this way, the insulating adhesive tape 4 tightly attaches to the surface of the coil, and an isolation layer for insulating the coil 3 from the surroundings is formed on the surface of the coil 3 so as to make the coil 3 waterproof and dustproof.

Figure 5:
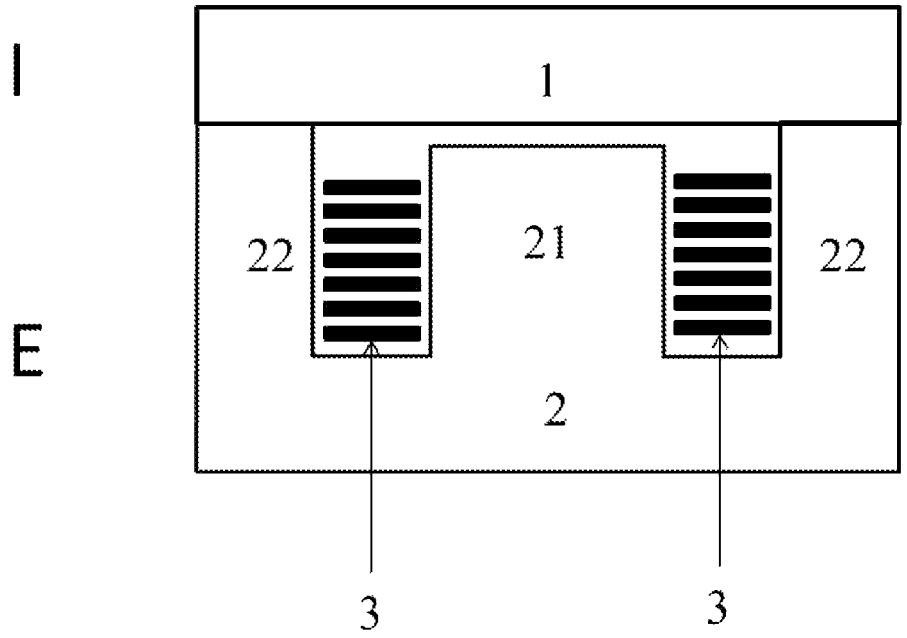
FIG. 5 is a cross-sectional view of the combination of the coil and the E-I shaped magnetic core shown in FIG. 1.

FIG. 5 is a cross-sectional view of the combination of the coil 3 and the E-I shaped magnetic core shown in FIG. 1, wherein for clarity, the insulating adhesive tape 4 is omitted. As shown in FIG. 5, the coil 3 is located in a space enclosed by the I shaped magnetic core 1, the central column 21 and the side column 22, so as to surround the central column 21 of the E shaped magnetic core 2.

The reactor provided in the present embodiment uses the coil formed by vertically winding a flat wire. Since the flat wire is wider and has better self-supporting, it is not necessary to provide a coil holder when winding the flat wire and thus a coil without a coil holder can be formed. The shape of the coil is regular, hence, the insulating adhesive tape can be tightly attached to the coil without leaving gaps, such that the waterproof and dustproof performance of the insulating adhesive tape is greatly improved. Accordingly, there is no need to add additional waterproof and dustproof parts, for example housing and sealing resin, which will increase the volume of the inductance coil. Therefore, the volume of the reactor of the present invention is greatly reduced.

In addition, vertically winding is an efficient way for winding. For a certain air gap, a higher inductance value is available in the limited space. For a certain inductive value, the volume occupied by the reactor achieved through vertically winding is smaller than that occupied by other reactors achieved through other winding ways. Therefore, the volume of the reactor is further reduced.

Additionally, in the conventional coil winding way, it is necessary to wind multiple layers of copper wires so as to meet the requirements. However, air gaps with lower thermal conductivity between each layer of the coils are unavoidable, which may cause a high temperature difference between the inside and outside of the coils, even as high as 40° C. Due to this, the internal temperature of the coils may be too high and thus damage the enamel-cover of copper wire and cause interturn short circuit, resulting in the burned inductor. The vertical winding coil of the present embodiment uses a flat wire, the surface of which is perpendicular to the axis around which the coil is wound. Therefore, one layer of the coil can meet requirements. It prevents too high internal temperature and reduces the temperature difference between the inside and outside of the coils.

Embodiment 2

As described in the embodiment 1, an air gap G with a height h is formed between the central column 21 and the I shaped magnetic core 1. However, leakage flux will cause the central column 21 and the I shaped magnetic core 1 provided on both sides of the air gap G to vibrate and collide, resulting in a noise. The present embodiment provides a reactor which can avoid this noise.

Figure 6:
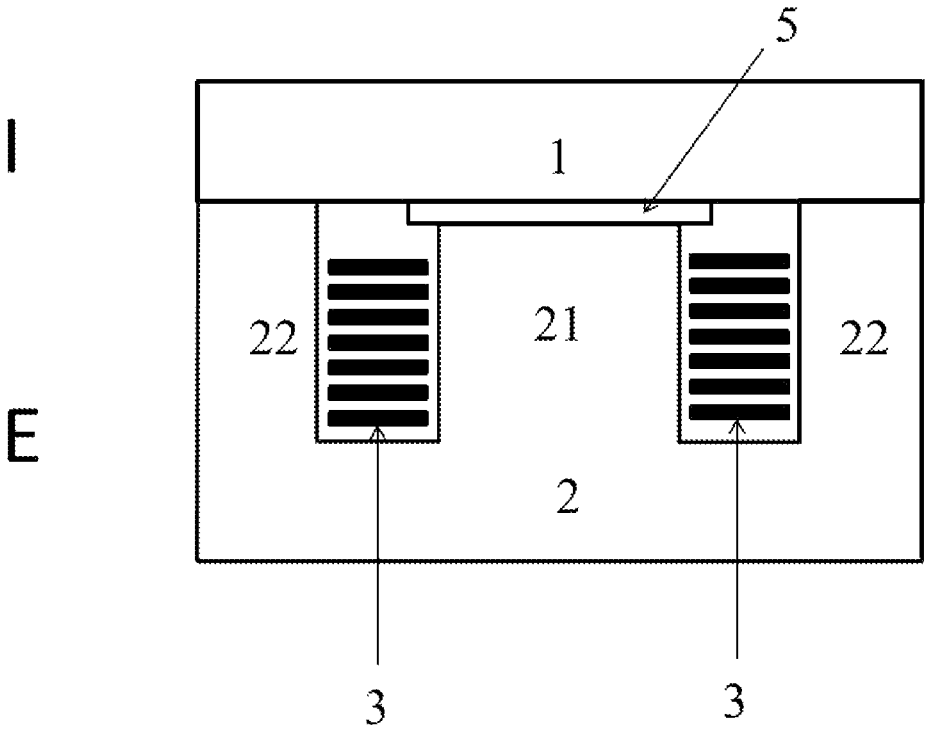
FIG. 6 is a cross-sectional view of the E-I shaped magnetic core including an insulating gasket.

FIG. 6 shows a reactor of the present embodiment, the structure of which is basically the same as that of the reactor provided in the embodiment 1. The structures are different in that an insulating gasket 5 is provided between the central column 21 and the I shaped magnetic core 1. The insulating gasket 5 is positioned against to the central column 21 and the I shaped magnetic core 1, and can not only provide the functionality of the air gap, but also avoid the vibration and collision of the central column 21 and the I shaped magnetic core 1, thereby avoiding a noise. The insulating gasket 5 may be made of, for example insulating material such as silicone, and preferably a flexible insulating material.

According to other embodiments of the present invention, insulation materials such as epoxy resin can also be filled in the gap between the E-I shaped magnetic core and the coil 3 so as to prevent them from colliding with each other, and prevent turns of the coil colliding with each other due to the effect of electromagnetic force, which may further reduce noises.

According to other embodiments of the present invention, other waterproof and dustproof measures can also be provided to the above reactor so as to further improve its waterproof and dustproof performance. For example, after assembling the coil 3 and the E-I shaped magnetic core, the assembly may be immersed in the Varnish, baked and cooled, and dipped into waterproof paint. It can also improve waterproof and dustproof performance without increasing the volume of the reactor. In addition, a leading out terminal of the coil 3 may be coated with a sealing gum or sleeved with a heat-shrinkable tube to prevent the tape near the leading out terminal not being completely sealed. Using either one of the above waterproof and dustproof measures or any combination of them, the reactor can be completely sealed as a whole such that it is impossible for water to enter any location of the reactor and a high level of waterproof can be achieved.

In the above embodiments, the E-I shaped magnetic core as an example of the reactor according to the present invention has been described. Those skilled in the art will appreciate that the reactor provided in the present invention is not limited to the E-I shaped magnetic core, and other types of magnetic cores may be used based on actual needs.

In essence, the reactor provided in the above embodiments is an inductance coil. The reactor of the above embodiments can also be used in other occasions applying inductance coil, such as inductors, transformers, choke coils, etc. Therefore, the present invention provides an inductance coil, which can be used in any occasion applying inductance coil, for example used as reactors, inductors, chock coils, transformer coils, etc.

Finally, it should be noted that the above embodiments are merely provided for illustrating the technical solutions of the present invention and not for limiting. Although the present invention has been described in detail with reference to the embodiments, those skilled in the art will appreciate that the technical solutions of the invention can be modified or replaced by equivalents, without departing from the spirit and scope of the invention, which are covered by the protection scope of the claims of the invention.

What is claimed is:

1. An inductance device comprising:

a magnetic core that extends along an axis;

a coil wound around the magnetic core, wherein the coil comprises a wire comprising a flat surface and a consistent size; and the flat surface of the wire is perpendicular to the axis such that the coil comprises an exterior surface that comprises a top portion perpendicular to the axis, a bottom portion perpendicular to the axis, and sides that extend parallel to the axis from the bottom portion to the top portion; and an isolation surface on the exterior surface of the coil, wherein the isolation surface comprises an adhesive tape that extends from the bottom portion of the coil to the top portion of the coil substantially along a direction parallel to the axis, and there are no gaps between the isolation surface and the exterior of the coil.

2. The inductance device of claim 1, wherein the isolation surface prevents dust and water from reaching the coil such that the coil is waterproof and dustproof.

3. The inductance device of claim 1, wherein the isolation surface comprises a waterproof paint.

4. The inductance device of claim 1, wherein the coil further comprises a leading out terminal, and the wire and the leading out terminal comprise the flat surface and consistent size.

5. The inductance device of claim 4, wherein the leading out terminal of the coil is sleeved with a heat-shrinkable tube.

6. The inductance device of claim 4, wherein the leading out terminal of the coil is coated with a sealing gum.

7. The inductance device of claim 1, wherein the magnetic core is an E-I shaped magnetic core, a central column of the E-I shaped magnetic core extends along the axis, and the coil surrounds the central column.

8. The inductance device of claim 1, wherein the magnetic core has an air gap, and an insulator in the air gap.

9. The inductance device of claim 1, wherein the inductance device is a reactor, an inductor, a choke coil or a transformer coil.

10. The inductance device of claim 1, wherein the coil is self-supporting and the inductance device does not include a separate holder to support the coil.

11. An electromagnetic device comprising:

an inductance device, the inductance device comprising:

a magnetic core that extends along an axis;

a coil wound around the magnetic core, wherein the coil comprises a wire comprising a flat surface and a consistent size; and the flat surface of the wire is perpendicular to the axis such that the coil comprises an exterior surface that comprises a top portion perpendicular to the axis, a bottom portion perpendicular to the axis, and sides that extend parallel to the axis from the bottom portion to the top portion; and an isolation surface on an exterior surface of the coil, wherein the isolation surface comprises an adhesive tape that extends from the bottom portion of the coil to the top portion of the coil substantially along a direction parallel to the axis, and there are no gaps between the isolation surface and the exterior of the coil.

12. The electromagnetic device of claim 11, wherein the isolation surface prevents dust and water from reaching the coil such that the coil is waterproof and dustproof.

13. The electromagnetic device of claim 11, wherein the isolation surface comprises a waterproof paint.

14. The electromagnetic device of claim 11, wherein the coil further comprises a leading out terminal, and the wire and the leading out terminal comprise the flat surface and consistent size.

15. The electromagnetic device of claim 14, wherein the leading out terminal of the coil is sleeved with a heat-shrinkable tube.

16. The electromagnetic device of claim 14, wherein the leading out terminal of the coil is coated with a sealing gum.

17. The electromagnetic device of claim 11, wherein the isolation surface prevents dust and water from reaching the coil such that the coil is waterproof and dustproof, and the electromagnetic device is not contained in a housing or sealed by an additional sealing device.

18. A component for a reactor, the component comprising:

a coil wound around a space configured to receive a magnetic core, the space extending along an axis, wherein the coil comprises a wire comprising a flat surface and a consistent size; the coil is wound with the flat surface of the wire perpendicular to the axis;

and the wound coil comprises an exterior surface that comprises a top portion perpendicular to the axis, a bottom portion perpendicular to the axis, and sides that extend parallel to the axis from the bottom portion to the top portion; and an adhesive tape wrapped around the exterior surface of the coil, wherein the adhesive tape that extends from the bottom portion of the coil to the top portion of the coil, and there are no gaps between the adhesive tape and the exterior of the coil.

* * * * *